US006634855B1

(12) United States Patent
Rollo

(10) Patent No.: US 6,634,855 B1
(45) Date of Patent: Oct. 21, 2003

(54) IMPELLER AND FAN INCORPORATING SAME

(75) Inventor: Peter Eric Rollo, Wellington (NZ)

(73) Assignee: Rollo Enterprises Limited, Wellington (NZ)

( * ) Notice: Subject to any disclaimer, the term of this patent is extended or adjusted under 35 U.S.C. 154(b) by 0 days.

(21) Appl. No.: 09/180,307

(22) PCT Filed: May 7, 1997

(86) PCT No.: PCT/NZ97/00055

§ 371 (c)(1),
(2), (4) Date: Nov. 6, 1998

(87) PCT Pub. No.: WO97/42416

PCT Pub. Date: Nov. 13, 1997

(30) Foreign Application Priority Data

May 7, 1996 (NZ) ..... 286535

(51) Int. Cl.[7] ..... F04P 29/30

(52) U.S. Cl. ..... 415/206; 415/220; 416/183; 416/185; 416/186 R; 416/187; 416/223 B; 416/237

(58) Field of Search ..... 415/204, 206, 415/220; 416/183, 185, 186 R, 184, 187, 223 B, 228, 235, 237

(56) References Cited

U.S. PATENT DOCUMENTS

| | | | | | |
|---|---|---|---|---|---|
| 1,892,930 | A | * | 1/1933 | Burman | 415/206 |
| 2,727,680 | A | * | 12/1955 | Madison et al. | 416/184 |
| 3,069,071 | A | | 12/1962 | Carlson | 415/220 |
| 3,584,968 | A | * | 6/1971 | Keith | 415/220 |
| 3,856,431 | A | * | 12/1974 | Tucker | 415/206 |
| 3,904,308 | A | * | 9/1975 | Ribaud | 415/143 |
| 4,324,529 | A | * | 4/1982 | Nickels | 416/187 |
| 4,531,890 | A | | 7/1985 | Stokes | |
| 4,618,313 | A | * | 10/1986 | Mosiewicz | 416/237 |
| 4,647,271 | A | * | 3/1987 | Nagai et al. | 416/186 R |
| 5,620,306 | A | * | 4/1997 | Day | 416/185 |

FOREIGN PATENT DOCUMENTS

| | | | | |
|---|---|---|---|---|
| DE | 1 093 041 | | 11/1960 | |
| GB | 19003 | | of 1915 | |
| GB | 869662 | A | 6/1961 | |
| GB | 887100 | | 1/1962 | |
| JP | 58-101297 | * | 6/1983 | 415/206 |
| NL | 110389 | | 1/1965 | |

* cited by examiner

*Primary Examiner*—Christopher Verdier
(74) *Attorney, Agent, or Firm*—Young & Thompson

(57) ABSTRACT

An impeller having an axis about which the impeller is rotatable in a working direction of rotation A, with a plurality of aerofoil blades spaced from and arranged about the axis; the inwardly axis-facing surface of each blade defines a longer fluid flow path across the blade than the opposite outwardly-facing surface, and each blade has an angle of attack from 0° up to a positive angle of attack less than that at which the blade will induce turbulent fluid flow when the impeller is rotated in a fluid at a working speed in the working direction of rotation A so that during such rotation the impeller induces an inlet fluid flow generally axially toward the impeller and an outward fluid flow away from the impeller, where the outward flow is in directions generally inclined at an angle which lies between substantially radial and axial directions relative to the axis.

21 Claims, 7 Drawing Sheets

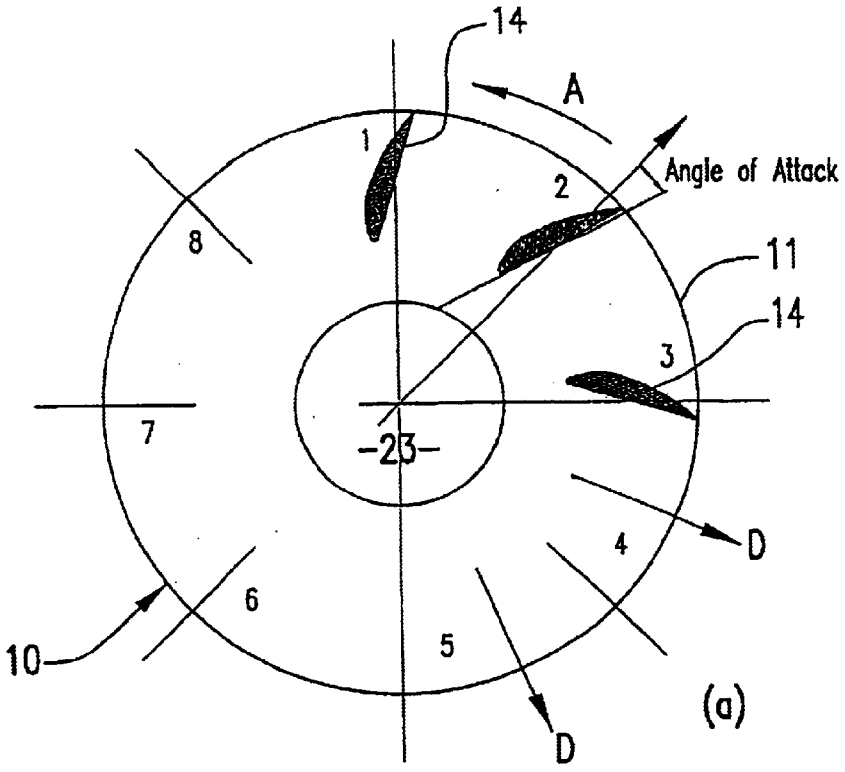
FIG. 10
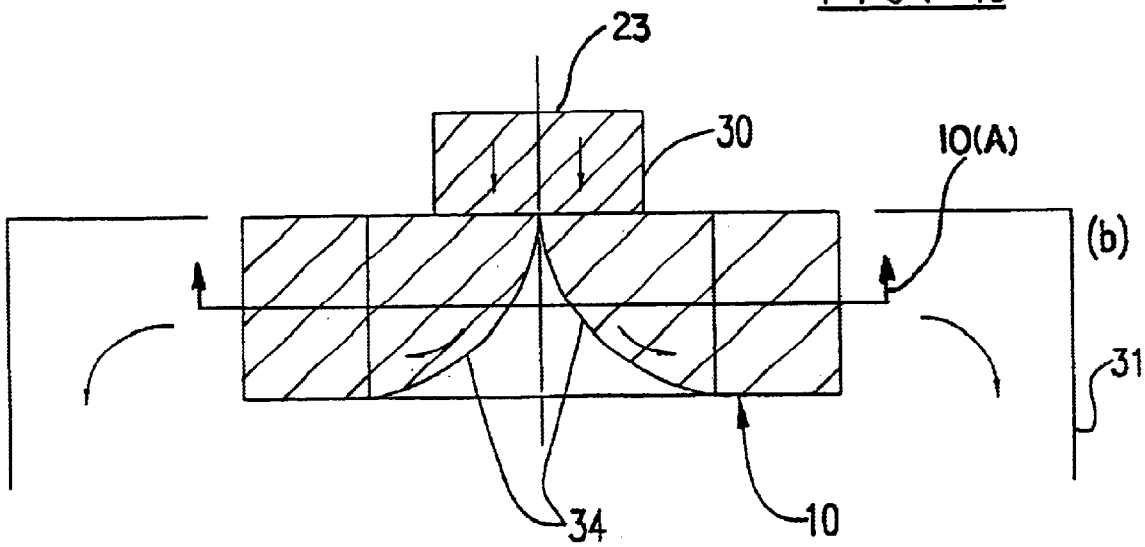

IMPELLER AND FAN INCORPORATING SAME

This application was filed as PCT International application No. PCT/NZ97/00055 on May 6, 1997 and claims priority under 35 USC §119 based on New Zealand application No. 286535 filed on May 7, 1996.

BACKGROUND OF THE INVENTION

This invention relates to improvements in impellers and devices (e.g., fans) incorporating same.

Forced transport of fluid is commonly achieved through the use of a centrifugal or axial flow fan. An axial flow fan impeller consists of a common propeller like component for drawing fluid (typically air) in from one side and out through the other side. The fluid travels substantially in a straight line along the propeller's axis assisted by the shape and construction of the propeller housing. In contrast the impeller of a centrifugal fan is wheel-like in appearance and the outgoing fluid travels in a direction substantially perpendicular to the axis of rotation.

The efficiency characteristics (directly related to the running cost) of both types of fans are determined by the number, size, shape and general fluid dynamic properties of the blades which comprise the fan. The operating speed and impeller housing can also have a marked effect on the efficiency. Common fans or pumps of both types have been found to be relatively expensive and/or noisy in operation.

SUMMARY OF THE INVENTION

The object of the present invention is primarily concerned with improving the efficiency of the impellers used in fans or pumps. Another significant object of the invention is to provide an impeller with substantially less operating noise.

The present invention provides a third class 6f fan and fan impeller. For a somewhat descriptive name, the fan can be called a multiflow fan, i.e., one which combines the properties of axial with transverse flow. The multiflow impeller has some similarities to centrifugal impellers but differences in the shape and orientation of its blades means that it is has a minimal or no centrifugal effect on the air flow through the fan.

The multiflow fan of the present invention can produce a high output at high efficiency. That means the costs for power used in running the fan may be reduced below those of a centrifugal fan having an impeller of the same diameter and having the same output. The power input is to a large degree constant at high volume flows and static pressure is maintained. The multiflow fan can be operated at a reduced speed and there are no unstable operating regions in the performance curve at any speed. It is an advantage that the impeller can be used with a conventional scroll-type housing or any other housing configuration that is suitable for a centrifugal impeller or in tubular or rectangular casing suitable for axial impellers.

In one broad aspect of the invention there is provided a fan impeller having an axis about which the impeller is rotatable in a working direction of rotation, and a plurality of aerofoil blades lying spaced from and arranged about the axis, the inward axis-facing surface of each blade defining a longer fluid flow path across the blade than the opposite outward axis-facing surface of the blade, and with each blade having an angle of attack from 0° up to a positive angle of attack less than that at which the blade will induce turbulent fluid flow when the impeller is rotated in a fluid at a working speed in the working direction of rotation, whereby rotation of the impeller in the working direction of rotation induces an inlet fluid flow generally axially towards the impeller and an outlet fluid flow away from the impeller in directions generally inclined about 30° or more or less relative to the axis.

In a second broad aspect of the invention there is provided a fan comprising a housing having an inlet and an outlet and a fluid flow path between the inlet and the outlet, an impeller as defined above mounted in the flow path within the housing to be rotatable about its axis, and drive means enabling the impeller to be rotated in its working direction of rotation to cause fluid flow from the inlet to the outlet of the housing.

The aerodynamic properties of the blades of the multiflow impeller described herein are similar to those of an aircraft wing and can be likened particularly to when the aircraft is performing a loop or inward turn.

BRIEF DESCRIPTION OF THE DRAWINGS

FIGS. 10*a* and 10*b* are respectively a sectional view from the inlet and sectional plan view of the impeller used for power generation.

DESCRIPTION OF THE PREFERRED EMBODIMENTS

In the first form of the invention as illustrated the impeller 10 has an axis 12 about which the impeller is rotatable in a working direction of rotation indicated by the arrow A. Eight aerofoil blades 14 lying spaced from and substantially parallel to the axis are mounted onto a disc 11 which in turn is fixed on the opposite side of the blades to a motor (not illustrated) along axis 12.

The number of blades 14 in this embodiment is fixed at eight but it is not restricted to this number. It is possible to have any number greater than two up until what is practically possible to fit on the disc 11. The optimum number has been found to be between four to twelve (preferably eight) for the uses tested during development. However impellers with different diameters, uses and blade widths may have another optimum.

Figure 2:
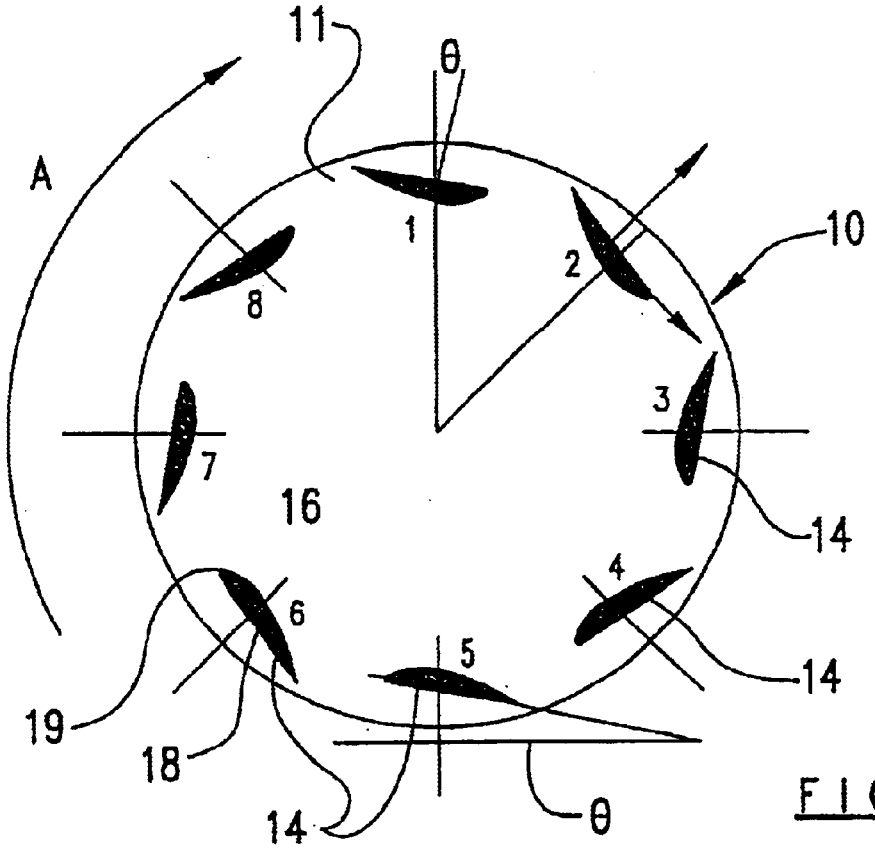
FIG. 2 is a side view of the impeller in FIG. 1 detailing the aerofoil blade cross-section.

As best shown in FIG. 2, the blades 14 are arranged in a circular array about the axis 12 with each blade being equidistance from adjacent blades and the axis of rotation 12. The impeller 10 assumes a generally cylindrical shape.

The blades 14 are of a substantially equivalent shape to one another, the shape being characterised by an inwardly facing surface 16 defining a longer fluid flow path across the blade than the opposite outwardly facing surface 18. The pressure differential created by this characteristic is the basis of the aerofoil principal upon which this invention is based. The leading edge is denoted by reference numeral 19.

Furthermore, each aerofoil blade 14 is arranged on the disc 11 to have an "angle of attack" (shown as θ on the top or blade number 1 of FIG. 2). The angle of attack is preferably greater than 0° (not a negative angle). There is a maximum angle whereat turbulent fluid flow is induced hence the angle of attack is preferably between 0° and the turbulent fluid flow angle (TFFA). The angle of attack according to preferred forms of the invention does not exceed substantially 22°.

Each blade of the impeller 10 is therefore shaped and arranged to operate in a similar manner to that of an aircraft wing when the impeller is rotated in the direction of the blades leading edge 19. At any instant in time the blade 14 is moving horizontally forward and around the center.

To carry the "wing" analogy further, the upper surface of a wing induces a lower pressure to that of the bottom surface. This causes the "lift" of an aircraft and enables it to gain altitude. In the impeller the "wing's" top surface is the inwardly facing section 16 of the blade. The effect of this is for the fluid to flow substantially perpendicularly outward from the axis of rotation which in aircraft terms is equivalent to down-wash. An increase in angle of attack increases the volumetric flow at a given rpm (not exceeding the TFFA). The TFFA is equivalent to the stall angle of an aircraft.

The fluid flow thus occurs in a similar manner to that of a centrifugal impeller but without utilising a centrifugal effect to any significant extent. The angle of blades of centrifugal impellers are not restricted. In practical fans they are usually fixed above about 25° to a tangent to the radial.

To increase the strength of the impeller and to provide some form of seal with the housing 22, the distal ends of the blades 14 are joined by a support ring 20. The impeller 10 is rotatably mounted within the housing 22, shown in dashed outline. This is known as a scroll-type housing as used for centrifugal impellers. The fluid inlet is in the direction 12 through the inlet opening 23. The fluid outlet is denoted by reference numeral 24 in the direction of the arrow B. The outlet 24 is generally arranged along a tangent to the impeller 10 but other arrangements are possible.

In comparison to a centrifugal impeller where the blades extend proportionally further into the centre of the impeller disc, the impeller of the invention has the blades 14 closer to the periphery of disc 11 for an equivalent volumetric flow. This means the inlet 23 is proportionally larger than in a centrifugal fan using the same diameter disc (11). The larger the inlet 23, the lower the fluid velocity through the inlet for the same volumetric fluid flow. The overall effect of this proportional characteristic is a reduced degree of turbulence and noise for the multiflow impeller compared to a conventional centrifugal impeller.

In axial flow applications in a tubular housing the disc enables build up of static pressure between the inlet and outlet.

Figure 3:
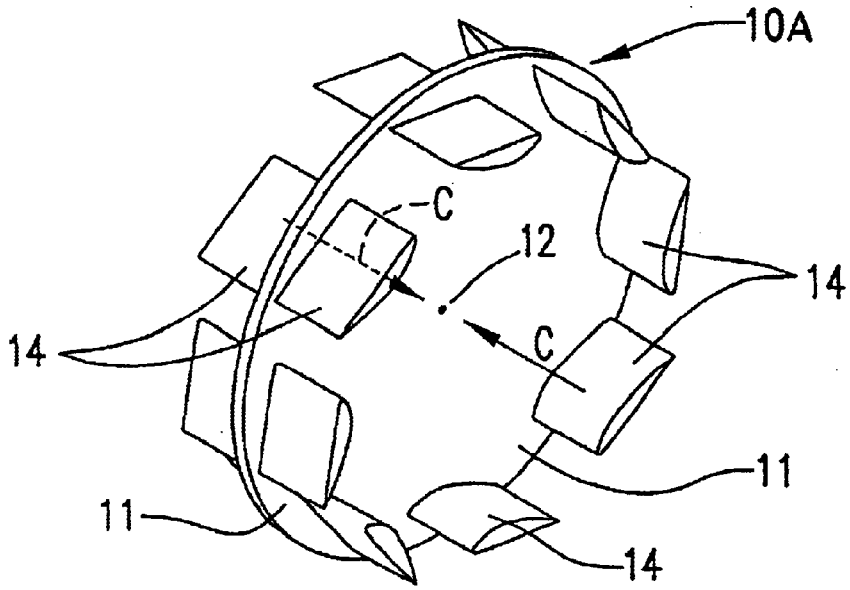
FIG. 3 is a general view of a second form of the impeller according to the invention.

In a second form of the invention as illustrated in FIG. 3, there is provided a twin inlet impeller 10*a*. Blades 14 are provided either side of the rotating disc 11 and fluid input is shown by center bound (one shown in dotted detail) arrows C. The individual blades 14 of FIG. 3 may be half the perpendicular height of those of FIG. 1 to achieve the same volumetric flow for an equivalent sized fan. However the fluid velocity is halved on each side of the fan—further reducing turbulence and noise as compared to a centrifugal fan.

Figure 6:
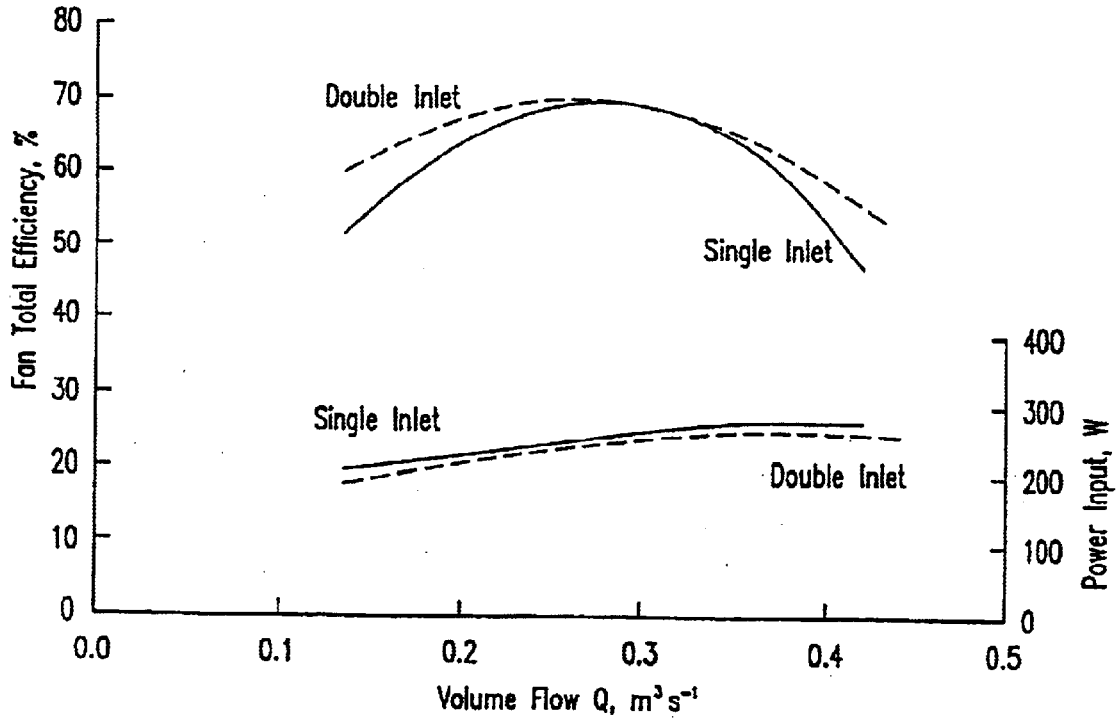
FIG. 6 is an efficiency/power input vs volumetric flow graph comparing the performance of alternative embodiments of the impeller according to the invention, FIG. 7(*a*) is an illustration of fluid flow in an embodiment of the impeller according to the invention, FIG. 7(*b*) is a similar illustration of fluid flow in an alternative embodiment of the impeller according to the invention.

The blade geometry of a single inlet impeller is not directly comparable to that of the same overall dimensioned double inlet version. However blade geometry can be chosen that reaches a close similarity. FIG. 6 compares the performance of single to double inlet impellers in both total efficiency and power input. The double inlet impeller has a higher efficiency overall than the single inlet impeller over the range of flow rates but the peaks are essentially the same. As expected the power input into the single inlet fan is then slightly higher than the double inlet version for the same volumetric flow rate. Power input is shown on the right hand scale of FIG. 6.

Figure 1:
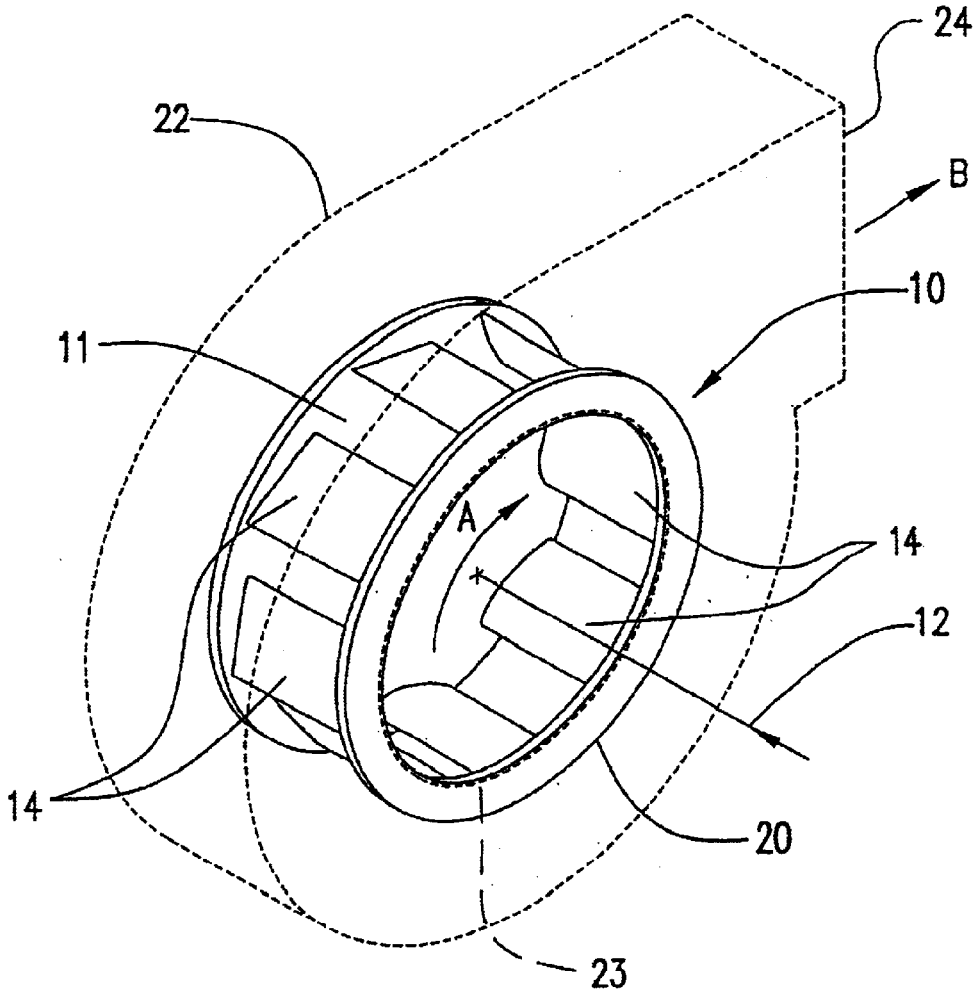
FIG. 1 is a general view of one form of the impeller according to the invention.

The shorter length of blade in FIG. 3 means the distal ends of the blades may not require the support ring 20 of the FIG. 1 arrangement. Each blade is subjected to centrifugal forces in use and these impose a radially outward directed bending moment on each blade which is reduced for shorter blades. Blade bending alters the output flow characteristics of the impeller.

To optimise the output of the impeller according to the invention, it is desirable to have as large an angle of attack or pitch as possible within an operating range which does not initiate turbulent flow. This gives the most economical operation costs.

During experimentation for this impeller it was found that a pitch θ of 18° was optimum for the volumetric flow required and corresponding rpm. As conditions vary for different uses of the invention the characteristic parameters must be defined. There will be a different optimum pitch dependent on a given fluid type (gas, liquid, shear thickening/shear thinning) and required flow rate and rpm.

The ratio of the chord length of a blade 14 to the radius at which that blade is mounted to disc 11 has preferably been found to be in the range of about 0.4 to 0.5 (preferably 0.43 to 0.45) by experiment but may vary according to the desired blade/space ratio.

The blades 14 are preferably rectangular in shape in plan view. Further embodiments (not illustrated) can include other shapes such as trapezoids with a swept forward trailing edge. This shape has the advantage of less noise but gives no gain in flow output.

Figure 4:
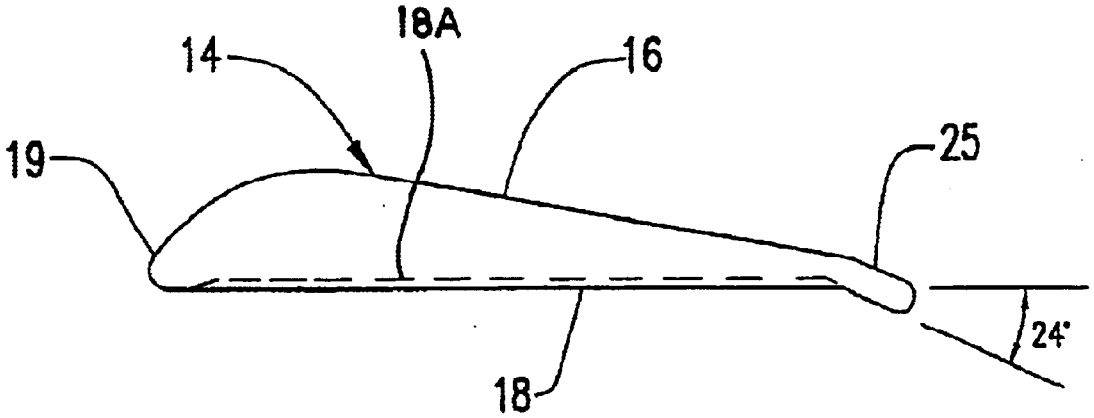
FIG. 4 is a side view of an impeller blade according to a third embodiment of the invention.

FIG. 4 shows a section of a blade 14. The outwardly facing surface 18 is preferably flat but a certain degree of concavity 18*a* can have the effect of an increase in pitch (there are no efficiency gains however). Generally a convex surface will degrade performance.

The inwardly facing surface 16 is intended to have a longer fluid flow path than surface 18. This is achieved by a bulged leading edge 19 which leads to a preferably substantially flat surface from approximately 40% of the length from the leading edge through to the trailing edge. This profile was found to be optimal and again is similar to an aircraft wing.

FIG. 4 also encompasses a fourth embodiment of the invention by the addition of flaps or deflectors 25 at the trailing edges of the blades (again, analogous to an aircraft wing). The deflector is preferably angled outwardly from the center of rotation at an acute angle relative to a chord line extension from the trailing edge of the blade. The angle may be between substantially 15° and 35°. The deflector 25 may be tapered from the root end of the blade towards the distal end of the blade, this in effect producing a "twisted" blade.

In a further embodiment the blade 14 itself may be tapered, with decreasing thickness from the root end to the distal end (still maintaining a rectangular plan view).

Figure 5:
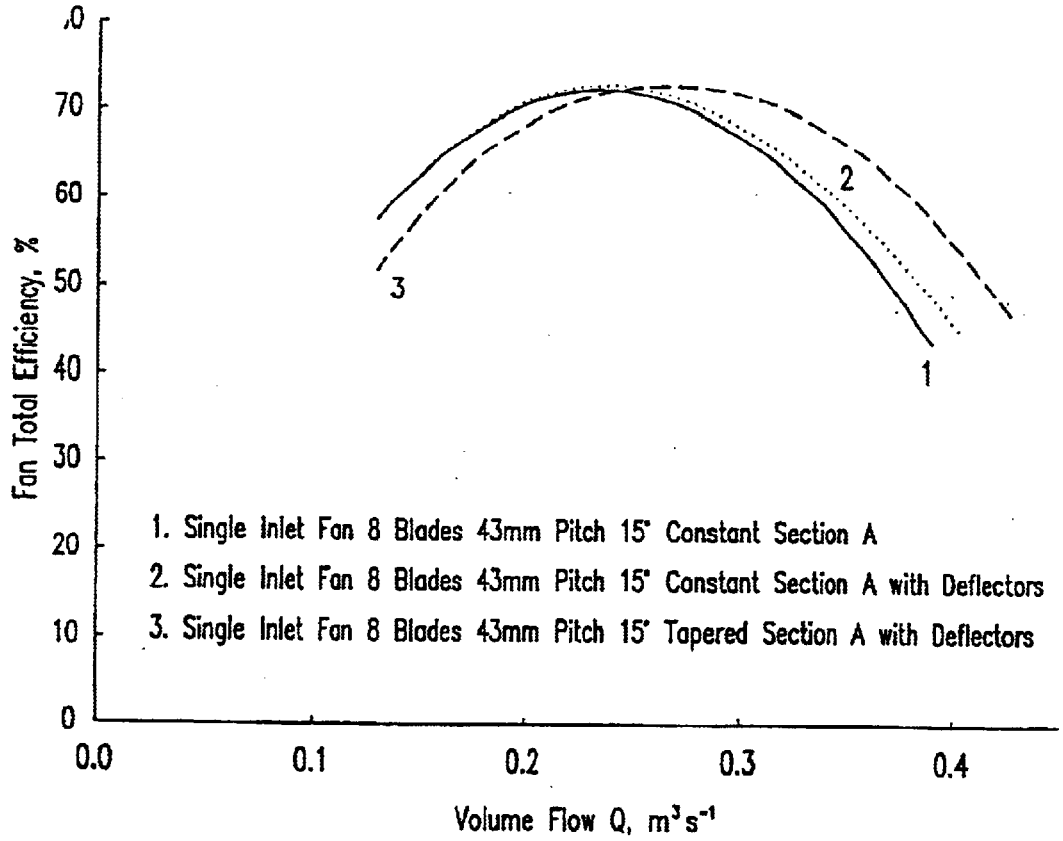
FIG. 5 is an efficiency vs volumetric flow graph comparing the performance of alternative embodiments of the invention.

FIG. 5 is a performance graph comparing constant section blades with deflected blades and tapered, deflected blades. The peak total efficiency in all cases was 71%. The tapered section blade with deflectors produced 10% higher efficiency at increased volumetric flow indicating this would be the preferred embodiment in a high flow rate situation. The tapered blade had the same initial section as the constant section blade but tapered away to half the ordinates at its distal end. All blades monitored were equivalently sized.

The deflected constant section blade gave an overall improved efficiency over a non-deflected blade of up to 2% in all volumetric flow rates.

Figure 7:
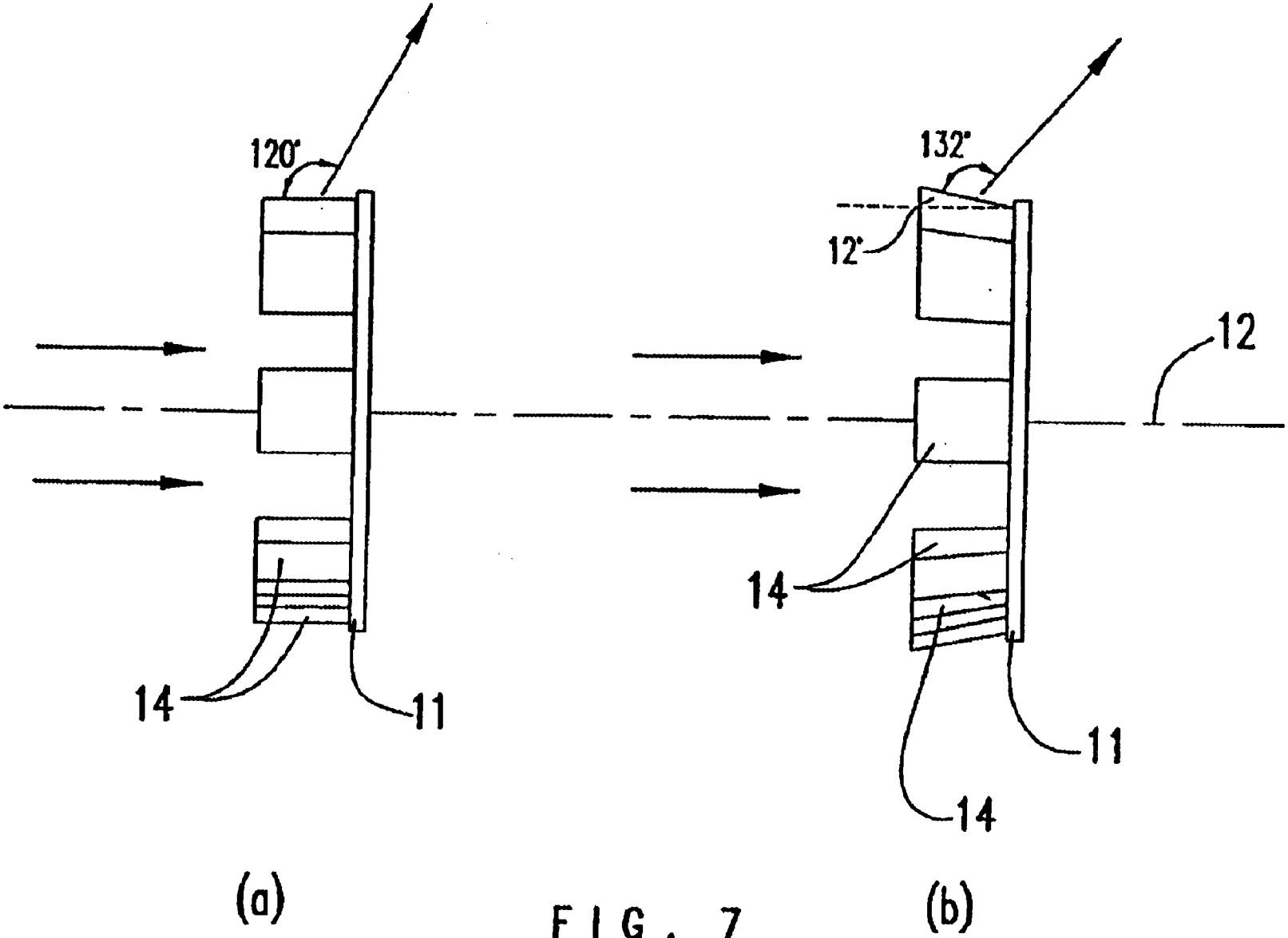

In a sixth embodiment of the impeller according to the invention the blades 14 can be arranged to produce a frusto-conical appearance as illustrated in FIG. 7. FIG. 7(*a*) shows that there is a tendency for the fluid flow of the first embodiment to leave the impeller with a rearwards angle of 120° relative to the fluid entry. When the blades are angled outwardly by 12° to a frusto-conical shape of FIG. 7(*b*), the outlet fluid flow from the impeller is at 132° from the inlet. This property may be useful depending on the use of the impeller and the type of housing required. The frusto-conical impeller will have a greater inlet area than the cylindrical embodiment hence reducing fluid velocity and noise. The frusto-conical impeller also finds use in achieving higher efficiencies for in-line flow.

Another option that exists for the invention includes adjustable-pitch blades. Varying the pitch of the blades changes the efficiency at given flow rates so a variable impeller will have more uses over a wider range than a fixed blade impeller. Mechanisms to automatically adjust pitch with flow rate changes can be developed and similar control can be achieved to that already used to adjust axial fans.

It is possible to have on the one impeller, blades located at different radii from the axis, blades with different spacings between them, different blade shapes and/or different blade pitches. Such an impeller is expected to have a reduced efficiency however, such multiple blade assemblies at fixed radii are possible and may prove advantageous (e.g. generating higher pressures and lower noise) in some circumstances.

Figure 8:
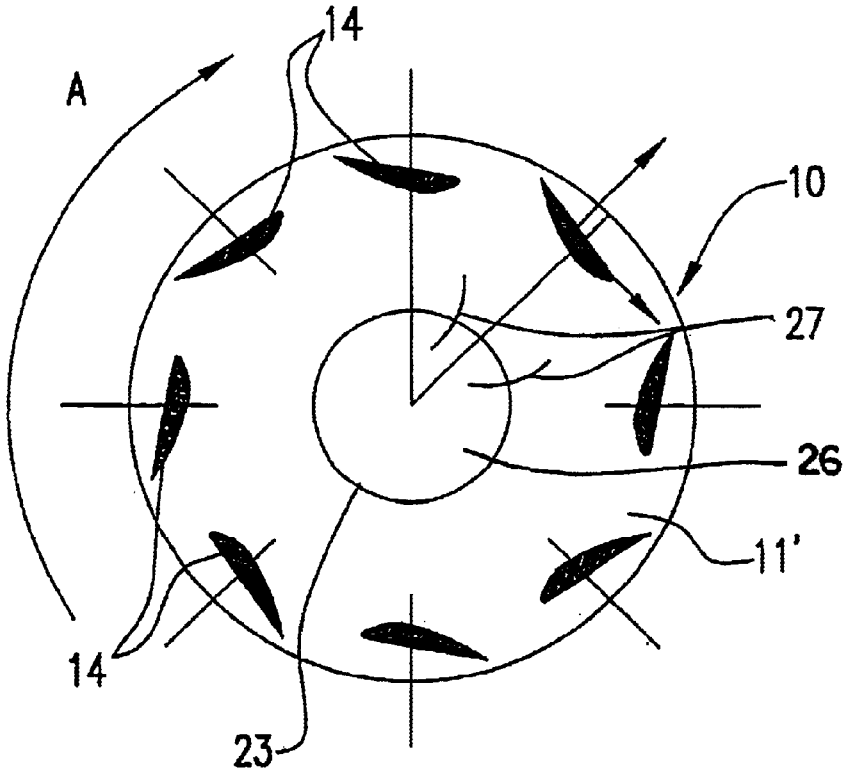
FIG. 8 is a side view of a further form of impeller incorporating the present invention.

A still further embodiment of the impeller according to the present invention is shown in FIG. 8, the impeller in this arrangement being capable of producing high vacuuming cleaning equipment and displays, and generally a lower tonal sound quality compared with an equivalent centrifugal impeller. For very high vacuum (say, 80 inches water) centrifugal blades added to the inlet section of the impeller of the present invention enhance the impeller's performance in all aspects of noise level, efficiency and degree of vacuum.

As shown in FIG. 8, the impeller 10 has disc 11' of annular shape with centrally disposed inlet 26. Disposed about the inlet 26 (in fact overlapping same) and mounted to disc 11' are a plurality of centrifugal blades 27 which are preferably backward curved.

It is also envisaged that the centrifugal blades could be replaced by a set or sets of the aerofoil blades of the present invention but of decreasing size and of decreasing radii.

The impeller according to the present invention may also be used to advantage when coupled to conventional centrifugal and axial impellers. For example, the performance of the frusto-conical impeller of the invention in a tube casing 28 with guide vanes 33 (FIG. 9) may be enhanced by the addition of a simple four bladed auxiliary axial type impeller 29 fitted in the inlet cone 30 and driven by a separate motor M' in a contra-rotating direction to impeller 10 driven by motor M. The power required to drive the auxiliary fan 29 is about one third to one quarter of that for the main impeller 10.

Figure 9:
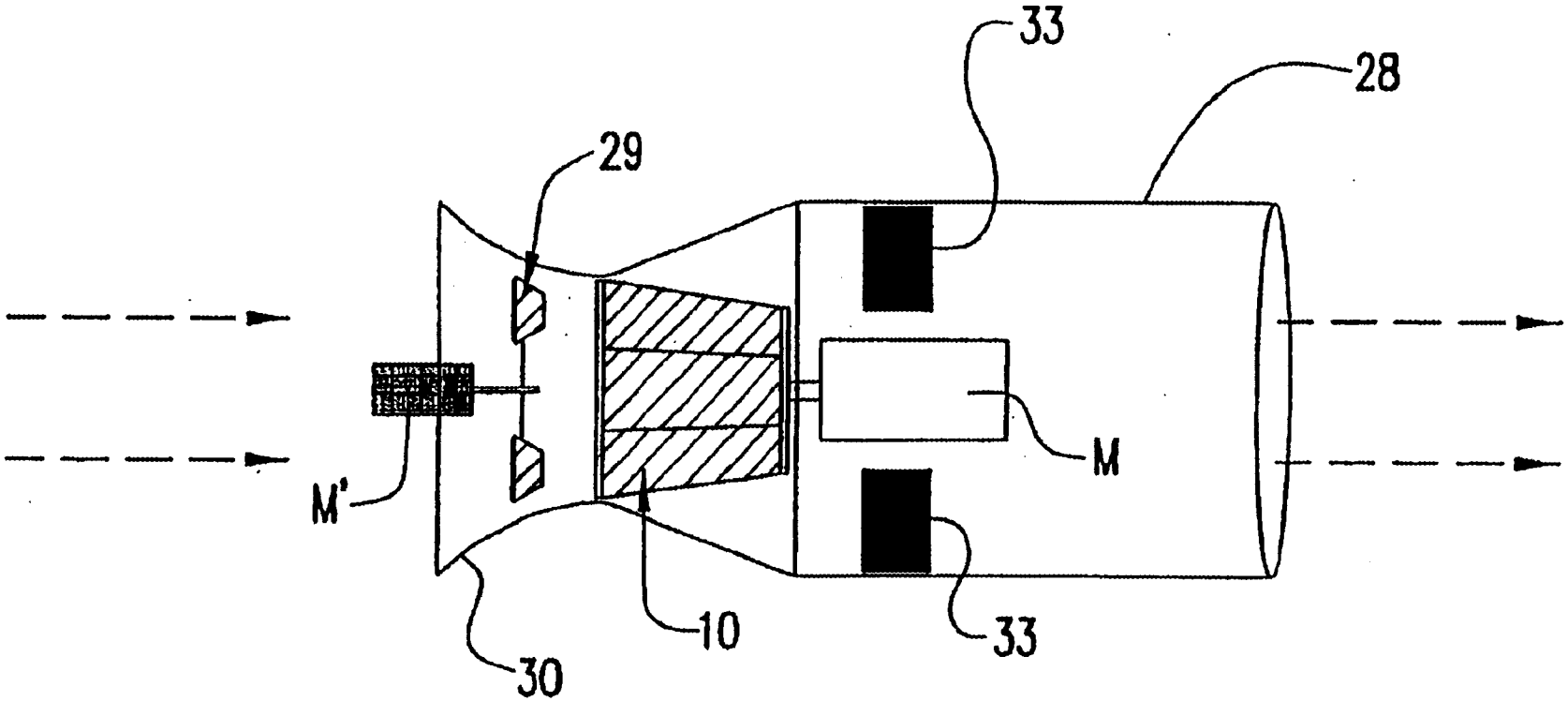
FIG. 9 is a sectioned schematic illustration of a fan incorporating the impeller of the invention.

In operation, the arrangement shown in FIG. 9 uses the air flow from the auxiliary impeller to benefit the main impeller and there is a clearly audible noise reduction. For example, the overall efficiency in tests showed an improvement by about 10%. The RPM of the main impeller 10 could be reduced by about 22% for the same volume flow and static pressure generated by a single impeller fan. The auxiliary impeller 29 could be readily retrofitted to an existing installation if upgrading was required. This arrangement, while most successful in a tubular casing as shown, would not be applicable to a scroll casing.

The above has described some preferred embodiments investigated in the development of the present invention but other embodiments or combinations of embodiments can be devised without departing from the broadly defined scope of the invention.

In all experiments (from which graphical representation was derived) the fluid used was air. Some embodiments may be more relevant to different fluids such as liquids used in processing industries. Varying optimum parameters will exist which must be determined dependent on the situation. Operating speed for use with liquids will usually be much lower (because of resistance or the risk of pump cavitation) than for gas use.

The impeller according to the invention will generally be driven by an electric motor and can be used with a variety of housings (including scroll-type) or, in some applications, no housing at all. It is possible to use the multiflow impeller interchangeably with either centrifugal or axial impellers.

The impeller according to the invention may ultimately have application as a propulsion method for vehicles (land, air and sea). It can also be used in air flow (e.g. wind) as a drive for a driven machine, for example a wind powered electricity generator.

The multiflow impeller of the present invention when adapted be either air or water driven for the purposes of power generation is shown in FIGS. 10*a* and 10*b*. For this purpose, blades 14 are rotated through about 90° as shown in FIG. 10*a*. In use, air passes through inlet 23 and exits as a fluid outward flow indicated by arrow D. In this arrangement the inlet 23 is formed by an inlet tube 30 and air would exit via a discharge tube 31. A system of inlet guide vanes 34 would be preferably used to set optimum angle of attack.

The impeller according to the present invention thus provides a construction with performance characteristics exceeding those of commonly available centrifugal or axial flow impellers for application in fans. The power consumption for a given operating volumetric flow rate for which the impeller is designed is lower than for an equivalently rated centrifugal or axial flow impeller. Hence the efficiency is higher for higher volume flow and thus power cost to the user is reduced. Generally the impeller is quieter in operation for equivalent volume flow and pressure (both positive and negative).

I claim:

1. An impeller having an axis about which the impeller is rotatable in a working direction of rotation (A), and a plurality of aerofoil blades arranged in a circular array lying spaced from and arranged from the axis with each blade being nominally at equal distance from adjacent blades, the inwardly axis-facing surface of each blade defining a longer fluid flow path across the blade than the opposite outwardly facing surface of the blade, said blades being arranged at an angle to the axis so that the impeller has a generally frusto-conical shape with a larger diameter inlet end and a smaller diameter outlet end, the inlet fluid flow into the impeller being via the larger diameter end, and with each blade having an angle of attack (θ) from 0° up to a positive angle of attack less than that at which the blade will induce turbulent fluid flow when the impeller is rotated in a fluid at a working speed in the working direction of rotation, said positive angle of attack not exceeding substantially 22°, whereby rotation of the impeller in the working direction of rotation (A) induces an inlet fluid flow generally axially towards the impeller and an outlet fluid flow away from the impeller in directions generally inclined at an angle which lies between substantially radial and substantially axial directions relative to the axis.

2. An impeller as claimed in claim 1, wherein the fluid is air and the outlet fluid flow away from the impeller is approximately 30° relative to the axis.

3. An impeller as claimed in claim 1, wherein the blades are end mounted to a disc.

4. An impeller as claimed in claim 1, wherein the ratio of the chord length of each blade to its radial distance from the axis is from substantially 0.4 to substantially 0.5.

5. An impeller as claimed in claim 4 where the ratio is from substantially 0.43 to substantially 0.45.

6. An impeller as claimed in claim 1 having four to twelve blades.

7. An impeller as claimed in claim 1, wherein each blade has the same shape and is at the same radii from the axis of rotation (A).

8. An impeller as claimed in claim 1, wherein each blade has the same angle of attack.

9. An impeller as claimed in claim 1, wherein the outwardly facing surface of each blade is substantially flat or concave.

10. An impeller as claimed in claim 1, wherein the inwardly facing surface of each blade is substantially flat for substantially 40% of the chord length measured from a leading edge of the blade to a trailing edge of the blade.

11. An impeller as claimed in claim 8 wherein the thickness of the aerofoil section of the blade at its distal end is about half that at its root end.

12. An impeller as claimed in claim 1, further including mounting means by which the impeller is mounted to be rotatable about its axis in use and to which a root end of each blade is attached.

13. An impeller as claimed in claim 12 wherein the blades are disposed on only one side of the mounting means.

14. An impeller as claimed in claim 12 wherein the mounting means is a disc.

15. A fan comprising:

a housing having an inlet and an outlet and a fluid flow path between the inlet and the outlet;

an impeller having an axis about which the impeller is rotatable in a working direction of rotation (A), and a plurality of aerofoil blades arranged in a circular array lying spaced from and arranged from the axis, with each blade nominally at equal distance from adjacent blades, the inwardly axis-facing surface of each blade defining a longer fluid flow path across the blade than the opposite outwardly facing surface of the blade, said blades being arranged at an angle to the axis so that the impeller has a generally frusto-conical shape with a larger diameter inlet end and a smaller diameter outlet end, the inlet fluid flow into the impeller being via the larger diameter end, and with each blade having an angle of attack (θ) from 0° up to a positive angle of attack less than that at which the blade will induce turbulent fluid flow when the impeller is rotated in a fluid at a working speed in the working direction of rotation, said positive angle of attack not exceeding substantially 22°, whereby rotation of the impeller in the working direction of rotation (A) induces an inlet fluid flow generally axially towards the impeller and an outlet fluid flow away from the impeller in directions generally inclined at an angle which lies between substantially radial and substantially axial directions relative to the axis, said impeller being mounted in the flow path within the housing, and a drive means enabling the impeller to be rotated in its working direction of rotation (A) to cause fluid flow between the inlet to the outlet of the housing.

16. A fan as claimed in claim 15 wherein the drive means is a motor.

17. A fan as claimed in claim 15 wherein the drive means includes connecting means by which a motor can be connected to drive the impeller.

18. A fan as claimed in claim 15 wherein the inlet of the housing develops fluid in an axial direction to the interior of the impeller.

19. A fan as claimed in claim 18 wherein the outlet of the housing receives fluid from the impeller upon a tangent to the periphery of the impeller.

20. A fan as claimed in claim 19 wherein the housing is a scroll-type housing.

21. A fan as claimed in claim 15 wherein the fluid flow from the impeller is directed in-line by a housing which is generally concentric with the axis of rotation.

* * * * *